US005772800A

United States Patent [19]

Heinz et al.

[11] Patent Number: 5,772,800

[45] Date of Patent: Jun. 30, 1998

[54] ALUMINIUM ALLOY PLATE AND METHOD FOR ITS MANUFACTURE

[75] Inventors: Alfred L. Heinz, Niederahr; Werner A. Schelb, Ransbach-Baumbach; Alfred J. P. Haszler, Vallendar; Otmar M. Muller, Koblenz, all of Germany

[73] Assignee: Hoogovens Aluminium Walzprodukte GmbH, Koblenz, Germany

[21] Appl. No.: 466,114

[22] Filed: Jun. 6, 1995

[30] Foreign Application Priority Data

| | | | |
|---|---|---|---|
| Jun. 9, 1994 | [NL] | Netherlands | 9400939 |
| Jan. 19, 1995 | [EP] | European Pat. Off. | 95200134 |
| May 12, 1995 | [EP] | European Pat. Off. | 9521243 |

[51] Int. Cl.[6] ..... C22F 1/04

[52] U.S. Cl. ..... 148/502; 148/552; 148/691; 148/437; 148/439

[58] Field of Search ..... 148/502, 552, 148/691, 437, 438, 439

[56] References Cited

U.S. PATENT DOCUMENTS

| | | | |
|---|---|---|---|
| 4,511,409 | 4/1985 | Ferton et al. | 148/439 |
| 5,277,719 | 1/1994 | Kuhlman et al. | 148/439 |

FOREIGN PATENT DOCUMENTS

| | | |
|---|---|---|
| 0500052 | 8/1992 | European Pat. Off. . |
| 2529578 | 1/1984 | France . |

OTHER PUBLICATIONS

"Advances If Fracture Research" Proc 7th Int. Conf. Houston, Texas 20–24, Mar. 1989, Pergamon, Oxford, GB, 1989 vol. 2, pp. 999–1007 P.E. Magnusen, et al The Influence of Material Quality on Airframe Structural Durability Figures 2, 3, Table 1.

Transactions of the American Foundryman's Society, vol. 94, 1986, USA pp. 47–56, M. Abbas, et al "Microporosity of Air Cast & Vacuum . . . ".

Journal of Testing and Evaluation, vol. 18, nr. 1, Jan. 1990, Phil., USA pp. 439–445, Magnusen, et al "Durability Assessment Based On . . . ".

Metallurgical Transactions, vol. 4, Apr. 1973, N.Y., USA, pp. 1069–1076, D–H. Chien, et al "Cast Microstructure and Fatigue Behavior of A High Strength Aluminium Alloy (DO–1)".

*Primary Examiner*—George Wyszomierski

*Attorney, Agent, or Firm*—Watson Cole Stevens Davis, P.L.L.C.

[57] ABSTRACT

An aluminium alloy plate is provided with a thickness of more than 2 inches, e.g. 6, 7 or 8 inches, and having an average logarithmic fatigue life of more than 100,000 cycles determined in accordance with ASTM test method E 466. The density of micropores with a size larger than 80 $\mu$m in all locations in the midplane (T/2) midwidth position at head and tail ends of the finished plate as measured by Optical Microscopy of samples in any plane perpendicular to the midplane is less than 0.025 micropores per cm$^2$. The plate may be formed by degassing of a melt to give a specified porosity of the cast ingot, and by hot rolling with at least one specified high reduction ratio pass.

39 Claims, 1 Drawing Sheet

ALUMINIUM ALLOY PLATE AND METHOD FOR ITS MANUFACTURE

BACKGROUND OF THE INVENTION

1. Field of the Invention

The invention relates to an aluminium alloy plate having a thickness of at least 2 inches (5 cm) and an average logarithmic fatigue life of more than 100,000 cycles determined in accordance with ASTM test method E 466. Such plates find particular application in the manufacture of structural members of aircraft, but are not limited to this use. The invention also relates to methods of manufacture of such plates.

2. Description of the Prior Art

Thick plate aluminium alloy of the above mentioned type used in the aircraft industry has high requirements imposed for fatigue properties. Often an average logarithmic life of 100,000 cycles and a minimum life of 80,000 cycles is required at a maximum stress amplitude of 35 ksi (241 MPa), a frequency of 10 hertz and a stress ratio of R=0.1, measured on test pieces with a diameter of M inch (1.25 cm) and a parallel measuring length of 2 inches (5 cm), determined in air at room temperature in accordance with ASTM E 466. This well-known test method is referred to as the "ASTM Test Method E 466 described herein", in this description and claims. All values for fatigue life referred to in this specification and claims are related to a maximum stress amplitude of 35 ksi (241 MPA). Here fatigue life is understood to be the so-called "constant amplitude smooth axial fatigue" wherein the test pieces lie in the LT direction (Long Transfer=width) and wherein for determining the average logarithmic life at least four test pieces are tested. The log-average fatigue life is given by $$\left\{ (1/N) \cdot \sum_{i=1}^{N} \log Nf(i) \right\}$$

where N is the number of specimens tested and Nf(i) is the fatigue life of the $i^{th}$ specimen.

In the past it has been difficult for plate with a thickness of more than 2 inches to meet the above requirements. In practice it has been found that the fatigue life of plate shortens the more thickness increases. Little is known about the cause of this phenomenon. It has been suggested that the cause should be sought in the microstructure of the plate and in particular in non-metallic inclusions and in micropores.

U.S. Pat. No. 5,277,719 describes manufacture of aluminium alloy plate by forming a melt, degassing the melt, casting the melt into an ingot, and shaping the ingot into the plate by a combination of forging and hot rolling. The method is said to achieve plates having a thickness of 5.7 inches with an improved fatigue life. The improvement is attributed to the forging technique in relation to porosity. It is mentioned that degassing is desirable to reduce hydrogen content. It is also stated that porosity should be reduced to not more than 0.05% for 3 to 6 inch plate and as high as 0.1% for plate 6 to 10 inches thick, because pores may act as sites for fatigue crack initiation.

An article "The influence of material quality on airframe structural durability" (Advances in Fracture Research, Proceedings of the 7th International Conference on Fracture, Houston March 1989, published Pergamon 1989, pages 999–1007) by Magnusen et al., analyses smooth axial fatigue performance in relation to fatigue crack development, in plates of thickness 5 or 6 inches. It is suggested that the data shows that longer fatigue life is associated with smaller microporosity size. Micropore size distributions given show peak pore lengths of about 0.1 mm. It is also mentioned that crack-initiating flaws may be other microstructural inhomogeneities such as inclusions, grain boundaries etc. A similar discussion by some of the same authors appears in Journal of Testing and Evaluation, 18, No.1, 1990, pages 439–445.

FR-A-2529578 describes a process for improving both fatigue resistance and toughness by forging steps combined with a step of hot compression in a transverse direction. The concern seems to be to improve the crystal microstructure.

The article "Microporosity of air cast and vacuum cast aluminium alloys" (Transactions of the American Foundryman's Society, 94, 1986, pages 47–56) describes the influence of processing techniques and composition on properties of aluminium alloys, including inter alia microporosity. Porosity is estimated by reference to theoretical density. There is no discussion of any relationship with fatigue life in plates.

An article "Cast microstructure and fatigue behaviour of a high strength aluminium alloy (KO-1)" by Chien et al. (Metallurgical Transactions, 4, 1973 pages 1069–76) describes how secondary dendritic arm spacing and volume percent microporosity increases with distance from the chill. Fatigue life was found to decrease with increasing distance from the chill. Solutionized specimens exhibit longer fatigue life, as a result of decrease in microporosity. It is concluded that microporosity and inclusions act as sources of stress concentration for fatigue crack initiation.

A long life is of great importance for a thicker plate because it permits weight to be saved in those applications in which plate fatigue characteristics are decisive.

SUMMARY OF THE INVENTION

An object of the invention is to provide a thick aluminium alloy plate with improved fatigue properties.

Another object of the invention is to create a method for the manufacture of a thick aluminium alloy plate with improved fatigue properties.

According to the invention in one aspect there is provided an aluminium alloy plate with a thickness of more than 2 inches having an average logarithmic fatigue life of more than 100,000 cycles determined in accordance with ASTM test method E 466 described herein, characterised in that the density of micropores with a size larger than 80 Am in all locations in the midplane (T/2) position of the finished plate, as measured by Optical Microscopy of samples in any plane perpendicular to the midplane, is less than 0.025 micropores per $cm^2$.

In research the applicants have found that, in the case of a thick plate, the micropores resulting from shrinkage are decisive for the lifetime. These micropores occur mainly in the midplane (T/2) position of the finished plate. With the present level of lifetimes, non-metallic inclusions are not thought decisive. Furthermore, the density of the micropores and not just their size was found to be related to lifetime. In research the applicant has found not only that the plate in accordance with the invention has far fewer micropores larger than 80 $\mu$m, but also that the total number of micropores was far smaller than in a plate in accordance with the state of the art.

Preferably in the plate in accordance with the invention the density of micropores with a size larger than 65 $\mu$m in all locations in the midplane (T/2) position of the finished plate is less than 0.025 micropores per $cm^2$.

The plate in accordance with the invention is further preferably characterized by the density of clusters of micropores in the plate. Not only is the density of the larger micropores decisive for the fatigue strength, but also the density of local concentrations of micropores may have significant effect.

A cluster is defined as a whole group of individual micropores in which the distance between any two neighbouring micropores is no greater than the maximum dimension of the largest micropore in the group.

Preferably therefore the density of clusters of micropores, as thus defined, with a size larger than 150 μm in all locations in the midplane (T/2) position of the finished plate as measured by Optical Microscopy of samples in any plane perpendicular to the midplane, is less than 0.025 clusters per $cm^2$. More preferably the density of clusters of micropores with a size larger than 100 μm in all locations in the midplane (T/2) position of the finished plate is less than 0.025 clusters per $cm^2$.

For long fatigue life, the plate desirably has a very low total volume porosity. Preferably the volume porosity of the plate is less than 0.005%, more preferably less than 0.001% and may be as low as 0.0002%.

In this aspect of the invention thick plate can be provided with an exceptionally long life, by which significant savings in weight can be achieved.

By the invention in particular it is possible to provide plates of thickness of the plate of 4 inches (10 cm), 5 inches (125 cm) or 6 inches (15 cm) or more, having usefully long life times.

Plates in accordance with the invention can be provided having an average logarithmic fatigue life of at least 250,000 cycles, or even at least 350,000 cycles.

Even thicker plates are now available with long life times. In accordance with the invention it is possible to provide a plate of thickness 7 inches (18 cm) or more having an average logarithmic fatigue life of at least 250,000 cycles. Further it is possible to provide a plate of 8 inches (20 cm) or more thickness with an average logarithmic fatigue life of at least 150,000 cycles.

Typically, aluminium alloys to which the invention may be applied have the following composition apart from aluminium and unavoidable impurities:

| | | |
|---|---|---|
| Cu | 0.3 to 3 | wt. % |
| Mg | 1 to 3 | wt. % |
| Zn | 5 to 9 | wt. % |
| Si | max. 0.4 | wt. % |
| Fe | max. 0.6 | wt. % |
| optionally | | |
| Mn | max. 0.5 | wt. % |
| Cr | max. 0.3 | wt. % |
| Zr, V, Hf, Nb | max. 0.3 | wt. % each. |
| Sc | max. 0.5 | wt. % |

In the invention, the aluminium alloy of the plate preferably belongs to the group of the AA 7xxx alloys, also known as the AA 7000 series alloys. Preferred specific alloys are AA 7050 T 7451 and AA 7150 T 7451.

The invention also provides methods of manufacturing aluminium alloy plates having a long fatigue life, particularly plates as defined above.

In a first method aspect, there is provided a method of manufacture of an aluminium alloy plate, comprising the steps of:

(a) preparing a melt of the alloy,
(b) casting the melt into an ingot,
(c) hot rolling the ingot into the plate by rolling the ingot in a plurality of passes.

The melt is degassed before casting to such an extent that in the solidified ingot before the hot rolling the density of micropores with a size larger than 80 μm as measured by Optical Microscopy of samples taken from the midplane (T/2) position of the ingot and perpendicular to the length direction of the ingot is less than 0.1 micropores per $cm^2$.

The number of these micropores in the ingot must be as small as possible, and where possible nil. Consequently it is specified that the density of the micropores with a size larger than 80 μm is less than 0.1 micropores per $cm^2$, and more preferably less than 0.07 micropores per $cm^2$. Such a low density means that less than 1 in a hundred micropores is larger than 80 μm.

The volume porosity of the ingot before hot rolling is preferably not more than 0.01%, more preferably not more than 0.005%.

Preferably the melt is degassed with a argon or a gas containing argon.

It should be noted that degassing an aluminium melt is of itself known from EP-A-500 052 for the removal of solid particles and gases from the aluminium melt, to refine it. However, the positive effect of this on the life of a finished thick plate is not described. Degassing is also described and explained in U.S. Pat. No. 3,839,019. Degassing is essentially a refining process to remove unwanted gases such as hydrogen and other impurities, by passing through the melt bubbles of a gas which is inert in the melt.

It has been found that with the limits specified for the micro porosity in the ingot, a thick plate can be obtained with a specially long life.

In a second method aspect, which is preferably combined with the first method aspect of degassing to a defined low porosity in the ingot, a hot rolling pass of large reduction is performed.

Thus the invention also provides a method of manufacture of an aluminium alloy plate with a thickness of at least 10 cm (4 inches), comprising the steps of:

(a) preparing a melt of the alloy,
(b) casting the melt into an ingot,
(c) hot rolling the ingot into the plate by rolling the ingot in a number of passes.

During at least one pass of the hot rolling the ingot is rolled with a reduction ratio $$\gamma = \frac{ho - hl}{ho},$$

in which expression ho is the entry thickness of the ingot in that pass and hl is the exit thickness of the ingot in that pass, the reduction ratio γ satisfying the condition:

$$\frac{\sqrt{4(R/ho)\gamma - \gamma^2}}{2 - \gamma} \geqq 0.50$$

in which R is the radius of the work rolls of the hot rolling stand.

In this method, preferably $$\frac{\sqrt{4(R/ho)\gamma - \gamma^2}}{2 - \gamma} \geqq 0.66.$$

If the second method is applied alone then preferably $$\frac{\sqrt{4(R/ho)\gamma - \gamma^2}}{2-\gamma} \geqq 0.60.$$

and the thickness of the aluminium alloy plate is more than 5.7 inches.

By a rolling reduction of the size given above, a part of the micropores present in the rolled piece, in particular in the midplane (T/2) position of the rolled piece, is eliminated, probably by the effect of diffusion.

Hot rolling of the ingot into thick plate takes place in a number of passes. In the first passes the roll stand does not permit a high reduction ratio to be applied. As a rule in the last passes a small reduction is applied for the sake of the flatness and surface roughness of the rolled piece. For this reason the high reduction ratio γ is preferably applied during one of the last five passes of the hot rolling. The number of passes is preferably greater than five and may be ten or more.

It has been found that with the specified large reduction ratio of at least one pass, there can be produced a thick plate with a specially long life.

It has particularly been surprisingly found that forging is not necessary in the manufacturing method. In the invention preferably the ingot is formed into the plate without any forging step.

The invention further extends to use of a plate of the invention described above or a plate made by a method of the invention described above, in the manufacture of an aircraft structural member.

DESCRIPTION OF THE PREFERRED EMBODIMENTS

Figure 1:
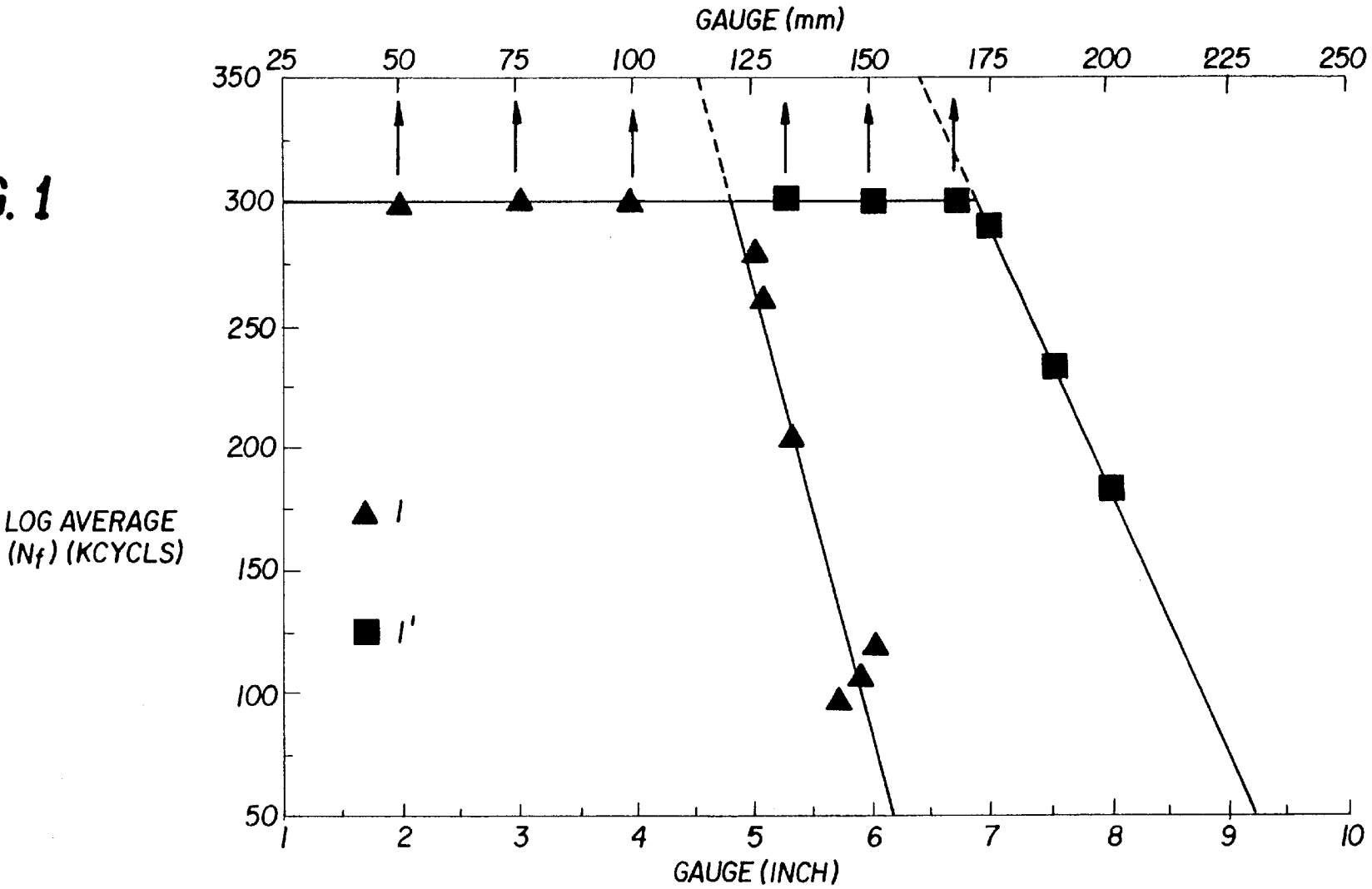
FIG. 1 is a graph plotting log-average fatigue life (in kcycles) against thickness of the plate, for aluminium alloy plates produced conventionally and plates in accordance with the present invention.

Embodiments of the invention will now be described by way of non-limitative example, and comparative examples representative of the state of the art will also be given.

Several melts were prepared of the aluminium alloy AA 7050. The melts were degassed in a continuous process in a SNIF Box T120 apparatus (Union Carbide) having two chambers and two rotors, by flow of argon gas. Rotor speed was 480 rpm. The mass flow of the melt during degassing was 0.25 ton melt/min. Gas flow rate was 4.5 $m^3$/h in degassing technique I referred to below and 6.5 $m^3$/h in degassing technique II. In one chamber 200 l/h chlorine was added. A high argon flow rate such as is used in degassing technique II, is generally considered to be detrimental to the purity of the melt. This is because impurities and air may be introduced into the melt as a result of turbulence in the melt due to the high argon flow rate. The degassed melt was then cast into ingots with a thickness of 440 mm (rectangular section) and the ingots were thereafter homogenised.

The porosity of the ingots was determined by Optical Microscopy. Samples measuring approximately 50×80 mm and approximately ½ inch thick were taken perpendicular to the longitudinal direction of the ingots. The samples were prepared by grinding and polishing. The material smoothed off the surface of the samples during grinding and polishing was removed by pickling with negligible increase in micropore size. The samples were examined by ultraviolet penetration. The ultraviolet reflections were noted and the samples examined under a light microscope in order to assess whether a reflection was attributable to a micropore or to an artefact (false image). Then the pore size distribution was determined with a light microscope and an image analyzing system.

The samples were taken from the midplane (T/2) position of the ingots (T is the thickness of the ingot), since maximum porosity occurs during solidification at the centre of the ingot. The Optical Microscopy revealed no micropores with a length exceeding 80 μm in samples of the ingots made by degassing technique II. Volume porosity was less than 0.005%. With the ingots without an increased volume flow of argon (degassing technique I) micropores were revealed of up to 120 μm and a micropore density larger than 80 μm of approximately 0.15 micropores per $cm^2$. Values for density of micropores in an ingot referred to in this specification and claims are related to a sample size of 50×80 mm.

The ingots were then hot rolled in a number of passes into plates with a thickness of 6 inches, using work rolls of radius 460 mm. Plates in accordance with the invention were rolled in ten passes, and in the seventh and eighth passes some of the ingots were given a high reduction ratio (seventh pass entry thickness 275 mm and exit thickness 225 mm, eighth pass entry thickness 225 mm and exit thickness 175 mm). Other ingots, rolled in accordance with the state of the art, were rolled in more passes and were given no such high reduction ratio in any pass, the reduction in any one pass being about 10 mm and a maximum of 20 mm. Such relatively low reduction ratio passes are normally given in the state of the art to avoid high rolling forces, which could result in damage to the rolling stand and loss of production. The plates were then solution heat treated, quenched, stretched by 2% and heat treated to condition T 7451.

The porosity of some of the plates was determined by Optical Microscopy as described above from samples measuring approximately 40×80 mm taken from the midplane (T/2) position (T is the thickness of the plate) with the measuring plane parallel to the length and the thickness directions i.e. perpendicular to the direction of width. This meant that the size of 80 mm extended in the direction of rolling and the size of 40 mm in the thickness direction and symmetrically to the midplane. These samples were taken from the mid width position.

Values for density of micropores and clusters in plates referred to in this specification and claims are related to a sample size of 40×80 mm.

The results are summarized in Tables 1 and 2.

TABLE 1

Cumulative density of micropores above the indicated size and volume porosity

| Pore size | Density [number of micropores per $cm^2$] | | |
|---|---|---|---|
| [μm] | A-1 | A-2 | C |
| >10 | 0.47 | 0.18 | 6.1 |
| >20 | 0.10 | 0.11 | 3.1 |
| >30 | 0.10 | 0.04 | 1.5 |
| >40 | 0.025 | 0 | 1.2 |
| >50 | 0 | 0 | 0.67 |
| >60 | 0 | 0 | 0.40 |
| >65 | 0 | 0 | 0.27 |
| >70 | 0 | 0 | 0.23 |
| >80 | 0 | 0 | 0.13 |
| >90 | 0 | 0 | 0.067 |
| >100 | 0 | 0 | 0.067 |
| Volume porosity | <0.0002% | <0.0002% | 0.005% |

TABLE 2

| Cumulative density of clusters above the indicated size | | | |
|---|---|---|---|
| Cluster size | Density [number of clusters per $cm^2$] | | |
| [$\mu$m] | A-1 | A-2 | C |
| >70 | 0 | 0 | 0.60 |
| >100 | 0 | 0 | 0.27 |
| >125 | 0 | 0 | 0.20 |
| >150 | 0 | 0 | 0.13 |
| >175 | 0 | 0 | 0.067 |
| >200 | 0 | 0 | 0.067 |
| >250 | 0 | 0 | 0.067 |

The pore size is the maximum dimension of a pore.

The density is the number of micropores or the number of clusters above the indicated size divided by the total examined surface of the sample.

A cluster is defined as a group of individual micropores in which the distance between any two neighbouring micropores is no greater than the maximum dimension of the largest micropore in the group. The cluster size is the maximum dimension of the cluster.

A-1 and A-2 are samples taken from plates of different melts, those plates being manufactured in accordance with the invention and with both degassing technique II and the high reduction ratio applied.

C are samples taken from plates which were manufactured with degassing technique I and without any high reduction ratio. These samples are representative of the state of the art.

The fatigue characteristics of the plates were determined in accordance with ASTM E 466 in air at room temperature on test pieces with a measurement length of 2 inch and a diameter of ½ inch taken from the midplane (T/2) position of the plates. The test conditions were: a maximum stress amplitude of 35 ksi (241 MPa), frequency of 10 hertz and stress ratio R=0.1. The so-called "constant amplitude smooth axial fatigue" was determined, wherein the test pieces were taken in the LT direction (Long Transfer=width) and wherein for determining the average logarithmic life at least four test pieces were tested. The results are summarized in Table 3.

TABLE 3

| Fatigue life | | |
|---|---|---|
| | Average logarithmic life [cycles] | Minimun life [cycles] |
| C | 110,612 | 81,890 |
| B-1 | 420,948 | 142,440 |
| B-2 | 382,945 | 169,075 |
| A-1 | 472,645 | 211,751 |

B-1=test pieces from plates made by degassing technique II and without the high reduction ratio passes in hot rolling.

B-2=test pieces from plates made by the high reduction ratio passes in hot rolling but degassing technique I. See Tables 1 and 2 for the meanings of A-1 and C.

The life tests were stopped at 500,000 cycles. This means that the actual values of the average logarithmic life were considerably higher in cases B-1, B-2 and A-1.

FIG. 1 shows fatigue lives of a number of other plates of a range of thicknesses, produced in accordance with the invention, and subjected to the same test (ASTM E 466). The plates whose lives are given by the filled triangles were made by a production technique I employing hot rolling without the high reduction ratio passes and to degassing technique I. The plates whose lives are given by the filled squares were made by the same hot rolling and degassing techniques as plates A-1 and A-2 above (Production technique II). The tests were terminated at 300,000 cycles, if failure had not occurred, so that for the points in FIG. 1 which lie on the horizontal line at 300,000, the vertical arrows indicate that the actual log-average fatigue life is substantially higher.

It is to be observed from FIG. 1 that the log-average values of the plates of the conventional production technique I show a sharp breakdown at a thickness of about 6 inches. In fact from the state of the art, there are no test values known for a thickness beyond 6 inches. As a first approximation the slope line of production technique I might be extrapolated as indicated by the dotted line to represent those unknown values. Apparently it is not possible to obtain plates with an acceptable lifetime by production technique I with a thickness beyond 6 inches.

The slope line representing plates of production technique II represents a substantial improvement for thick plates up to about 9 inches.

What is claimed is:

1. An aluminium alloy plate with a thickness of more than 2 inches having an average logarithmic fatigue life of more than 100,000 cycles determined in accordance with ASTM test method E 466, wherein the density of micropores with a size larger than 80 $\mu$m in the midplane (T/2) midwidth (W/2) position at head and tail ends of the finished plate as measured by Optical Microscopy of samples in a plane perpendicular to the width direction is less than 0.025 micropores per $cm^2$ and the volume porosity of the plate is less than 0.005%.

2. A plate in accordance with claim 1 wherein the density of micropores with a size larger than 65 $\mu$m in the midplane (T/2) midwidth (W/2) position at head and tail ends of the finished plate as measured by Optical Microscopy of samples in a plane perpendicular to the width direction is less than 0.025 micropores per $cm^2$.

3. A plate in accordance with claim 1 wherein the density of clusters of micropores, as defined herein, with a size larger than 150 $\mu$m in the midplane (T/2) midwidth (W/2) position at head and tail ends of the finished plate as measured by Optical Microscopy of samples in a plane perpendicular to the width direction is less than 0.025 micropores per $cm^2$.

4. A plate in accordance with claim 1 wherein the density of clusters of micropores with a size larger than 100 $\mu$m in the midplane (T/2) midwidth (W/2) position at head and tail ends of the finished plate as measured by Optical Microscopy of samples in a plane perpendicular to the width direction is less than 0.025 micropores per $cm^2$.

5. A plate in accordance with claim 1 wherein the volume porosity of the plate is less than 0.001.

6. A plate in accordance with claim 1 wherein the thickness of the plate is at least 4 inches.

7. A plate in accordance with claim 1 wherein the thickness of the plate is at least 5 inches.

8. A plate in accordance with claim 1 wherein the thickness of the plate is at least 6 inches.

9. A plate in accordance with claim 8 wherein said average logarithmic fatigue life is at least 250,000 cycles.

10. An aircraft structural member formed from an aluminium alloy plate in accordance with claim 9.

11. A plate in accordance with claim 8 wherein said average logarithmic fatigue life is at least 350,000 cycles.

12. An aircraft structural member formed from an aluminium alloy plate in accordance with claim 11.

13. An aircraft structural member formed from an aluminium alloy plate in accordance with claim 8.

14. A plate in accordance with claim 1 wherein the aluminium alloy of the plate is selected from AA 7xxx alloys.

15. A plate in accordance with claim 14 wherein the aluminium alloy of the plate is one of AA 7050 T 7451 and AA 7150 T 7451.

16. An aircraft structural member formed from an aluminium alloy plate in accordance with claim 1.

17. An aluminium alloy plate with a thickness of at least 7 inches having an average logarithmic fatigue life of more than 250,000 cycles determined in accordance with ASTM test method E 466, wherein the density of micropores with a size large than 80 $\mu$m in the midplane (T/2) midwidth (W/2) position at head and tail ends of the finished plate as measured by Optical Microscopy of samples in a plane perpendicular to the width direction is less than 0.025 micropores per $cm^2$ and the volume porosity of the plate is less than 0.005%.

18. An aircraft structural member formed from an aluminium alloy plate in accordance with claim 17.

19. An aluminium alloy plate with a thickness of at least 8 inches having an average logarithmic fatigue life of more than 150,000 cycles determined in accordance with ASTM test method E 466, wherein the density of micropores with a size larger than 80 $\mu$m in the midplane (T/2) midwidth (W/2) position at head and tail ends of the finished plate as measured by Optical Microscopy of samples in a plane perpendicular to the width direction is less than 0.025 micropores per $cm^2$ and the volume porosity of the plate is less than 0.005%.

20. An aircraft structural member formed from an aluminium alloy plate in accordance with claim 19.

21. An aluminium alloy plate with a thickness of more than 2 inches made from an ingot by hot rolling and without forging, having an average logarithmic fatigue life of more than 100,000 cycles determined in accordance with ASTM test method E 466, wherein the density of micropores with a size larger than 80 $\mu$m in the midplane (T/2 midwidth W/2) position at head and tail ends of the finished plate as measured by Optical Microscopy of samples in a plane perpendicular to the width direction is less than 0.025 micropores per $cm^2$ and the volume porosity of the plate is less than 0.005%.

22. An aircraft structural member formed from an aluminium alloy plate in accordance with claim 21.

23. A method of manufacture of an aluminium alloy plate with a thickness of more than 5 cm (2 inches) having an average logarithmic fatigue life of more than 100,000 cycles determined in accordance with ASTM test method E 466, comprising the steps of:

(a) preparing a melt of the alloy, (b) casting the melt into an ingot, and (c) hot rolling the ingot into the plate by rolling the ingot in a plurality of passes, the method further including degassing said melt before said casting to such an extent that in the solidified ingot before said hot rolling the density of micropores with a size larger than 80 $\mu$m as measured by Optical Microscopy of samples taken from the midplane (T/2) position of the ingot and perpendicular to the length direction of the ingot is less than 0.1 micropores per $cm^2$ and the volume porosity of the plate is less than 0.005%.

24. A method in accordance with claim 23, wherein said density of the micropores with a size larger than 80 $\mu$m is less than 0.07 micropores per $cm^2$.

25. A method in accordance with claim 23 wherein said degassing is performed by passing argon or a gas having argon as one of its constituents through said melt.

26. A method in accordance with claim 23 wherein said ingot is formed into said plate without forging.

27. The method according to claim 23 wherein degassing is conducted at a flow rate of $6.5M^3$ /h.

28. The method according to claim 23 wherein the ingot is not forged.

29. The method according to claim 28 wherein degassing is conducted at a flow rate of $6.5M^3$ /h.

30. A method of manufacture of an aluminium alloy plate with a thickness of more than 5 cm (2 inches) having an average logarithmic fatigue life of more than 100,000 cycles determined in accordance with ASTM test method E 466, comprising the steps of:

(a) preparing a melt of the alloy, (b) casting the melt into an ingot, and (c) hot rolling the ingot into the plate by roiling the ingot in a plurality of passes, the method further including degassing said melt before said casting to such an extent that in the solidified ingot before said hot rolling the density of micropores with a size larger than 80 $\mu$m as measured by Optical Microscopy of samples taken from the midplane (T/2) position of the ingot is less than 0.1 micropores per $cm^2$, and in at least one pass of said hot rolling, rolling the ingot using work rolls of radius R in a hot rolling roll stand with a reduction ratio $$\gamma = \frac{ho - h1}{ho}$$

in which expression ho is the entry thickness of the ingot in that pass and h1 is the exit thickness of the ingot in that pass, the reduction ratio $\gamma$ satisfying the condition $$\frac{\sqrt{4(R/ho)\gamma - \gamma^2}}{2 - \gamma} \geqq 0.66$$

and the volume porosity of the plate is less than 0.005%.

31. A method in accordance with claim 30, wherein $$\frac{\sqrt{4(R/ho)\gamma - \gamma^2}}{2 - \gamma} \geqq 0.66$$

32. A method in accordance with claim 30 wherein said plurality of passes of said hot rolling is greater in number than five and said pass of said hot rolling with said reduction ratio $\gamma$ is one of the final five passes of the said hot rolling.

33. A method in accordance with claim 30, wherein said ingot is formed into said plate without forging.

34. A method of manufacture of an aluminium alloy plate with a thickness of at least 4 inches having an average logarithmic fatigue life of more than 100,000 cycles determined in accordance with ASTM test method E 466, comprising the steps of:

(a) preparing a melt of the alloy, (b) casting the melt into an ingot, and (c) hot rolling the ingot into the plate by rolling the ingot in a number of passes, the method including in at least one pass of said hot rolling, rolling the ingot using work rolls of radius R in a hot rolling roll stand with a reduction ratio $$\gamma = \frac{ho - hl}{ho}$$

in which expression ho is the entry thickness of the ingot in that pass and h1 is the exit thickness of the ingot in that pass, the reduction ratio γ satisfying the condition $$\frac{\sqrt{4(R/ho)\gamma - \gamma^2}}{2 - \gamma} \geqq 0.50$$

and the volume porosity of the plate is less than 0.005%.

35. A method in accordance with claim 34, wherein $$\frac{\sqrt{4(R/ho)\gamma - \gamma^2}}{2 - \gamma} \geqq 0.60$$

36. A method in accordance with claim 34, wherein $$\frac{\sqrt{4(R/ho)\gamma - \gamma^2}}{2 - \gamma} \geqq 0.66$$

37. A method in accordance with claim 34, wherein the aluminium alloy plate has a thickness of more than 5.7 inches.

38. A method in accordance with claim 34, wherein said plurality of passes of said hot rolling is greater in number than five and said hot rolling pass of said hot rolling with said reduction ratio γ is one of the final five passes of the said rolling.

39. A method in accordance with claim 34 wherein said ingot is formed into said plate without forging.

* * * * *